United States Patent [19]

Coudron

[11] Patent Number: 4,674,130

[45] Date of Patent: Jun. 23, 1987

[54] CHILDREN'S SLEEPING BAG

[76] Inventor: Celestine A. Coudron, R.R. 1, Box 130, Marshall, Minn. 56258

[21] Appl. No.: 741,433

[22] Filed: Jun. 5, 1985

[51] Int. Cl.[4] ..... A41B 1/12; A41B 9/00

[52] U.S. Cl. ..... 2/69.5; 2/114; 2/DIG. 7

[58] Field of Search ..... 2/69.5, 114, DIG. 7, 2/69

[56] References Cited

U.S. PATENT DOCUMENTS

| | | | |
|---|---|---|---|
| 1,241,699 | 10/1917 | Barnes | 2/114 |
| 1,454,541 | 5/1923 | Falvey | 2/69 |
| 1,610,799 | 12/1926 | Lack et al. | 2/69 |
| 1,701,929 | 2/1929 | Mettam | 2/DIG. 7 |
| 2,128,796 | 8/1938 | Böhm-Myro | 2/114 |
| 2,141,739 | 12/1938 | Burke | 2/114 |
| 2,318,785 | 5/1943 | Kopplin | 2/114 |
| 2,429,168 | 10/1947 | Padgett | 2/114 |
| 2,535,936 | 12/1950 | Langley | 2/74 |
| 2,549,660 | 4/1951 | Buhl | 2/74 |
| 2,967,306 | 1/1961 | Fabanich | 2/114 |
| 3,812,539 | 5/1974 | Muehlberg | 2/DIG. 7 |
| 3,965,504 | 6/1976 | Ainsworth | 2/DIG. 7 |
| 4,383,336 | 5/1983 | Beckman | 2/114 |

*Primary Examiner*—Doris L. Troutman
*Attorney, Agent, or Firm*—James T. Beran

[57] ABSTRACT

A garment and a hand covering are disclosed which permit easy insertion of a child's body and of a hand, respectively, while preserving a limb or wrist opening when in the closed position. The garment includes a layer of covering material which has a neck opening and a body insertion opening. Along the sides of the body insertion opening, hook and loop type adhesive strips are mounted but these strips oppose each other along only part of the length of the opening, so that at least two limb openings are also defined along the body insertion opening at non-adhering portions. Arms or feet may extend through these limb openings. The hand covering according to the invention, which may be a mitten, has an extended opening extending from the wrist opening and a flap mounted on one side of the extended opening. A hook and loop type adhesive strip mounted on the inner surface of the flap contacts a similar strip mounted on the outer surface of the material to close the mitten when the hand is inserted.

12 Claims, 4 Drawing Figures

CHILDREN'S SLEEPING BAG

BACKGROUND OF THE INVENTION

1. Field of the Invention

The invention relates to clothing. More specifically, the invention relates to a sleeping bag and a mitten for children.

2. Description of the Prior Art

An article of clothing is typically shaped to cover a part of the body and has one or more openings for putting the article of clothing onto the body and for permitting parts of the body to extend out of the article of clothing while it is being worn. A body-length sleeping garment, for example, will typically have an opening for the head and arms, and may also have openings for the feet. A mitten will typically have one wrist opening through which the hand may be inserted and from which the arm extends while the mitten is being worn.

Various types of body-length sleeping garments for children are known. Barnes, U.S. Pat. No. 1,241,699, discloses a sleeping bag with openings for the head and the arms and with an opening across the bottom which may be buttoned for inserting a child into the sleeping bag. Padgett, U.S. Pat. No. 2,429,168, discloses a child's sleeping garment which similarly has a neck opening and arm openings and a large opening around the lower part of the sides and bottom through which the child may be inserted. Langley, U.S. Pat. No. 2,535,936, discloses a baby's sleeping bag in which two pieces of material are connected along their bottom and can be fastened along their sides. In all of these cases, when the bag is closed, the child's feet cannot extend out of the bag, which will prevent the child from walking and may cause discomfort if the temperature within the bag becomes too warm. Mettam, U.S. Pat. No. 1,701,929, discloses a sleeping bag with a neck opening, arm openings and foot openings, and with an additional opening for inserting the child which is closed by buttons. It would be advantageous, however, to provide a children's sleeping garment including a neck opening and limb openings but which would permit the child to be more easily inserted into the garment.

Burke, U.S. Pat. No. 2,141,739, discloses a mitten with an opening extending from the wrist end at the center of one side. Similarly, Buhl, U.S. Pat. No. 2,549,660, discloses a mitten which has an opening extending from the wrist and along one edge. Both Burke and Buhl, however, rely on a slide fastener such as a zipper to close these extended openings. It would be advantageous, however, to provide a mitten for a child with an opening extending from the wrist end which could be closed without the difficulty of operating a slide fastener such as a zipper.

SUMMARY OF THE INVENTION

The present invention provides a sleeping bag which has a head opening, arm openings and foot openings, but into which a child's body can be easily inserted. The sleeping bag can then be easily closed around the child's body.

The invention similarly provides a mitten into which a child's thumb can be easily inserted, and the mitten can then be easily closed around the child's hand without operating a slide fastener or other complicated closing structure.

The children's sleeping bag according to the invention includes a layer of clothing material for fitting around a child's body. A neck opening and a body insertion opening are defined in the clothing material. The clothing material has first and second opposing sides along the entire length of the body insertion opening, and first and second releasable adhering means are mounted opposite each other on the first and second opposing sides respectively, along a part of the length of the body insertion opening, so that at least a first and second limb opening are defined along the length of the body insertion opening in areas in which the first and second adhering means are not mounted opposite each other.

The layer of clothing material may include a front portion and a back portion, each of which is generally rectangular and has an upper edge, a lower edge opposite the upper edge, and two opposite side edges extending between the upper and lower edges. The neck opening may be defined at the center of the upper edge, and the front and back portions may be permanently fastened along the remainder of the upper edge. The body insertion opening may extend along one or more of the side edges and the lower edge, but in any case, the first and second adhering means will be mounted along only part of the length of the body insertion opening, so that at least two limb openings are defined along the length of the body insertion opening when the first and second opposite releasable adhering means are pressed together in the closed position.

The mitten according to the present invention similarly has an extended opening extending from the wrist opening, with first and second opposite sides along the extended opening. A flap is mounted to the first side of the extended opening, and first releasable adhering means is mounted on the flap while second releasable adhering means is mounted on the material of the mitten near the second side of the extended opening. The first and second releasable adhering means are mounted so that after the hand is inserted into the mitten, the extended opening may be closed by pressing the flap against the material of the mitten so that the first and second releasable adhering means contact each other.

The extended opening may extend along an edge of the mitten below the thumb portion, in which case the flap may extend toward the palm portion of the mitten for easy opening and closing of the mitten.

Other object, features and advantages of the invention will be apparent from the following description, together with the accompanying drawings and appended claims.

DETAILED DESCRIPTION OF THE PREFERRED EMBODIMENTS

Figure 1:
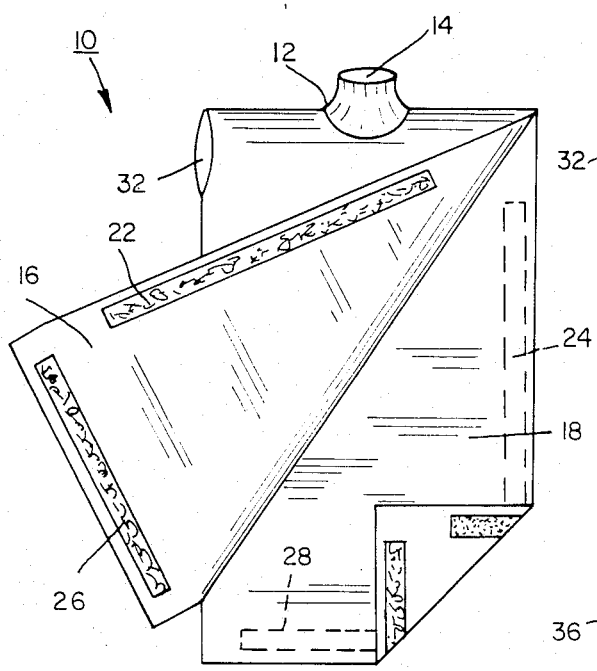
FIG. 1 shows a sleeping bag according to the invention with the body insertion opening in the open position.
Figure 2:
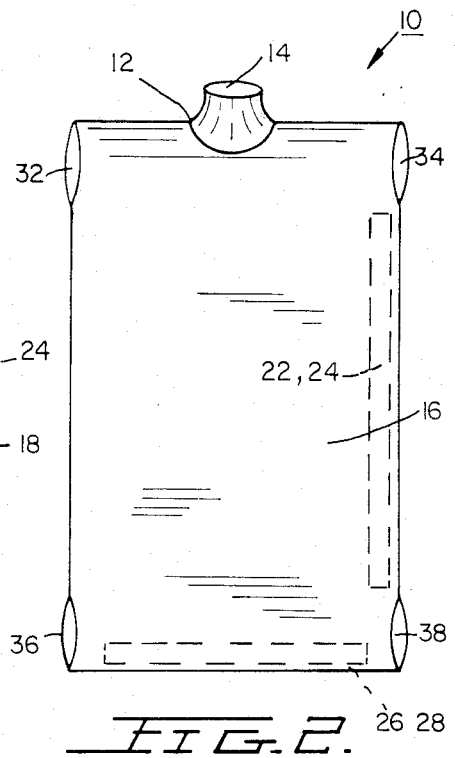
FIG. 2 shows the sleeping bag of FIG. 1 with the body insertion opening in the closed position.

The garment according to the invention, which may ordinarily be used as a children's sleeping bag, is shown in FIGS. 1 and 2. The basic bag 10 has a neck opening 12 defined along its upper edge, and may have an elastic material 14 fastened in the neck opening 12 for fitting tightly around the neck of the wearer in the nature of a pullover. The layer of clothing material which makes up the bag includes a front portion 16 and a back portion 18, which are permanently connected along the upper edge on either side of the neck opening 12 and, in the embodiment of FIGS. 1 and 2, along one of the side edges. As shown most clearly in FIG. 2, the front portion 16 and the back portion 18 are both generally rectangular pieces of clothing material, and may actually be cut from a single piece of material, so that the connection along the upper edge may be seamless. The connection along the side may, however, be a seam. Along the other edges of the bag, the front portion 16 and the back portion 18 are not permanently connected but have respective first and second opposing releasable adhering means, which may, for example, be hook and loop type adhesive strips such as Velcro strips. These releasable adhering means are mounted on the front portion 16 and the back portion 18 in opposing pairs, so that in one pair, first adhering strip 22 on front portion 16 is opposite second adhering strip 24 on portion 18, while in another pair, first adhering strip 26 is opposite second adhering strip 28, as shown in FIG. 1. FIG. 1 also shows second adhering strips 24 and 28 mounted on the side of back portion 18 which faces away from front portion 16, so that when first adhering strips 22 and 26 are adhered to strips 24 and 28, the edges of bag 10 become slightly rounded for greater comfort. The permanently connected edges may be similarly seamed.

In the embodiment shown in FIG. 1, an arm opening 32 is defined along the edge of bag 10 between the permanently connected upper edge and the permanently connected side edge. When bag 10 is closed, however, by the adhesion between the first and second adhering means, an additional arm opening 34 and foot openings 36 and 38 are also formed, as shown in FIG. 2. These additional openings result from the feature that the first and second opposing adhering means do not oppose each other along the entire length of the body insertion opening, but rather extend only along part of its length. In the remaining non-adhering parts of the length of the body insertion opening, the front portion 16 and the back portion 18 are not connected to each other in the closed position, leaving limb openings through each of which an arm or leg may extend.

The use of bag 10 shown in FIGS. 1 and 2 is extremely convenient, because when bag 10 is in the open position shown in FIG. 1, it is easy to pull it over the head and one arm of a child, with the head going through neck opening 12 and the arm going through arm opening 32. Then, first adhering strip 22 may be pressed against second adhering strip 24 to close the open side of the bag, with one arm extending through arm opening 34. If the legs of the child are spread apart, first adhering strip 26 may then be pressed against second adhering strip 28, closing the lower edge of bag 10, with the legs extending through foot openings 36 and 38. Alternatively, the lower edge may be closed before pulling bag 10 over the child's head, one arm and one leg. In this manner, bag 10 provides an easily used children's garment with openings for both arms and feet and which may be easily put on to a child. In addition, if the child is put into bag 10 in a reclining position, it is possible to close the side edge and lower edge of bag 10 by pressing the first and second releasable adhering means against each other, without the feet extending through the foot openings 36 and 38. Then, if the child wishes to stand up or becomes too warm, the feet may be pushed out of the foot openings 36 and 38.

Figure 3:
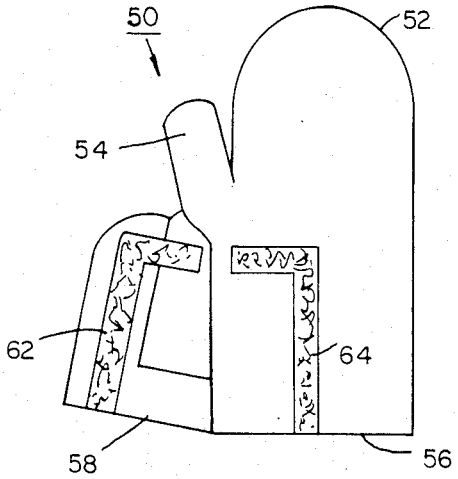
FIG. 3 shows a mitten according to the invention with the flap along the extended opening in the open position.
Figure 4:
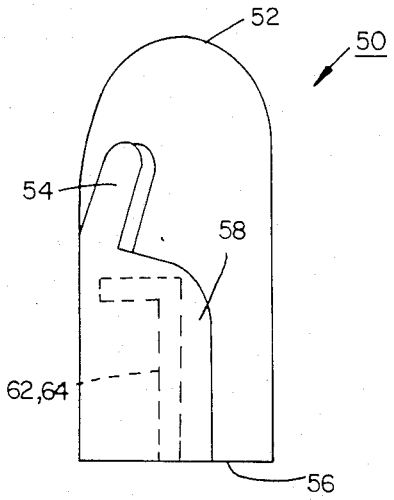
FIG. 4 shows a mitten according to the invention with the flap in the closed position.

A mitten 50 according to the invention is shown in FIGS. 3 and 4. As shown in FIG. 3, the mitten includes a finger portion 52 and a thumb portion 54. At the opposite end of the mitten is a wrist opening 56, and an opening extends upward from the wrist opening toward the thumb part 54. Along one side of this opening is connected a flap 58, and on the inner surface of flap 58 disposed toward the extended opening is mounted a first releasable adhering means 62. On the outer surface of the material of the mitten is also mounted a second releasable adhering means 64 which again may be a hook and loop type adhesive strip such as Velcro. First and second releasable adhering means 62 and 64 are positioned so that when a hand is inserted into the mitten 50, flap 58 may be pressed against the material of the mitten causing the first and second adhering means 62 and 64 to be pressed together, closing the mitten. In the closed position of the mitten 50, shown in FIG. 4, flap 58 is held against the material of the mitten by the first and second adhering means 62 and 64.

As shown in FIGS. 3 and 4, the extended opening extends to the base of the thumb portion 54 of the mitten. This has an added advantage, in that the thumb may be much more easily inserted into the thumb portion 54. This avoids the problem which occurs with conventional mittens in which, after the hand has been inserted into the mitten, it may be difficult to position the thumb in the thumb hole.

Many variations of the invention could be made. In the sleeping bag, for example, the body insertion opening could extend along only one side edge or only the lower edge or, on the other hand, around both side edges and the lower edge of the bag. The body insertion opening could include all or part of the upper edge of the garment, with appropriate means for providing the neck opening. In addition, the bag need not be rectangular but could take any convenient shape, and the limb openings could be positioned in any convenient positions along the length of the body insertion opening. The first and second adhering means may be positioned so that the limb openings are at the ends of the body insertion opening, or so that the limb openings are at intermediate points between the ends. The material from which the bag is made could be any appropriate fabric or other similar material and preferably include a batting or insulation between two layers of appropriate fabric, with a soft cotton or flannel being preferable for the layer next to the child's body. Similarly, the mitten could be any appropriate material and the extended opening of the mitten could be positioned at any point along the wrist opening. The flap may be shaped in any manner which permits the mitten to be closed.

Although the present invention has been described in connection with a plurality of preferred embodiments thereof, many other variations and modifications will now become apparent to those skilled in the art. It is preferred, therefore, that the present invention be limited not by the specific disclosure herein but only by the appended claims.

What is claimed is:

1. A garment for fitting around a body, comprising:

a layer of clothing material having a neck opening and a body insertion opening defined therein, the layer of clothing material further having first and second opposing sides extending along the length of the body insertion opening; and first and second means mounted on the first and second opposing sides, respectively, for releasably adhering to each other, the first and second releasably adhering means being mounted opposite each other along only a part of the length of the body insertion opening so as to define first and second non-adhering portions of the length of the body insertion opening, at most one of the first and second releasably adhering means being mounted along each of the first and second non-adhering portions, the first and second opposing sides being pressable against each other for closing the layer of clothing material around a body and for adhering the first and second releasably adhering means to each other in a closed position, the first and second non-adhering portions defining first and second limb openings, respectively, along the length of the body insertion opening for permitting limbs of the body to extend out of the garment in the closed position.

2. The garment of claim 1 in which both of the first and second releasably adhering means are not mounted along the first and second non-adhering portions of the body insertion opening.

3. The garment of claim 1 in which the layer of clothing material includes a front portion and a back portion, the first opposing side being defined on the front portion and the second opposing side being defined on the back portion, so that the body insertion opening extends between the front portion and the back portion.

4. The garment of claim 3, in which the front portion and back portion are each generally rectangular and have an upper edge, the neck opening being defined between the upper edges of the front and back portions, the upper edges of the front and back portion being connected to each other on either side of the neck opening.

5. The garment of claim 4 in which the front and back portions each have a lower edge opposite the upper edge, the body insertion opening extending along at least the length of the lower edges of the front and back portions.

6. The garment of claim 5, in which the front and back portions have respective first and second opposite side edges extending between the upper and lower edges, the body insertion opening extending at least along the length of the lower edges and the first opposite side edges of the front and back portions.

7. The garment of claim 6, in which the body insertion opening extends along the length of both the first and second opposite side edges and the lower edges.

8. The garment of claim 5, in which the front and back portions have a lower edge opposite the upper edge and have respective first and second opposite side edges extending between the upper and lower edges, the body insertion opening extending at least along the length of the first opposite side edges.

9. The garment of claim 1 in which the first limb opening is an arm opening and the second limb opening is a foot opening.

10. The garment of claim 1 in which the first and second limb openings are each foot openings.

11. The garment of claim 1 in which the first and second releasably adhering means are hook and loop type adhesive strips.

12. The garment of claim 1 in which the first and second releasably adhering means further define a third non-adhering portion, at most one of the first and second releasably adhering means being mounted along the third non-adhering portion, the third non-adhering portion defining a third limb opening along the length of the body insertion opening.

* * * * *